US011591719B2

(12) United States Patent
Stündl et al.

(10) Patent No.: US 11,591,719 B2
(45) Date of Patent: Feb. 28, 2023

(54) METHOD AND MELT SPINNING APPARATUS FOR PRODUCING A CRIMPED, MULTICOLORED COMPOSITE THREAD

(71) Applicant: Oerlikon Textile GmbH & Co. KG, Remscheid (DE)

(72) Inventors: Mathias Stündl, Wedel (DE); Eike Holle, Hamburg (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 607 days.

(21) Appl. No.: 16/618,230

(22) PCT Filed: May 23, 2018

(86) PCT No.: PCT/EP2018/063558

§ 371 (c)(1),
(2) Date: Nov. 29, 2019

(87) PCT Pub. No.: WO2018/219751

PCT Pub. Date: Dec. 6, 2018

(65) Prior Publication Data

US 2020/0115824 A1 Apr. 16, 2020

(30) Foreign Application Priority Data

May 31, 2017 (DE) ..... 10 2017 005 161.5

(51) Int. Cl.

| | |
|---|---|
| ***D01D 4/02*** | (2006.01) |
| ***D01D 5/088*** | (2006.01) |
| ***D01D 5/096*** | (2006.01) |
| ***D01D 5/08*** | (2006.01) |

(Continued)

(52) U.S. Cl.

CPC ..... *D01D 5/082* (2013.01); *D01D 5/22* (2013.01); *D02G 1/12* (2013.01); *D02G 1/122* (2013.01);

(Continued)

(58) Field of Classification Search

CPC ..... D01D 4/02; D01D 5/082; D01D 5/088; D01D 5/096; D01D 5/22; D01D 7/00;

(Continued)

(56) References Cited

U.S. PATENT DOCUMENTS

2002/0032955 A1 3/2002 Rasnick, Jr. et al.
2004/0031134 A1* 2/2004 Koslowski ..... D02G 1/122 28/263 X (Continued)

FOREIGN PATENT DOCUMENTS

EP 0861931 9/1998
EP 1146151 10/2001

(Continued)

OTHER PUBLICATIONS

Translation of JP-59116404-A (published on Jul. 5, 1984).*

*Primary Examiner* — Leo B Tentoni
(74) *Attorney, Agent, or Firm* — BainwoodHuang

(57) ABSTRACT

A plurality of colored filament bundles are initially extruded separately, cooled and each combined into a partial thread. The partial threads are then separately pre-swirled and stretched individually or as a partial composite thread formed from a plurality of partial threads. Crimping then occurs. After the crimping, the partial threads and the partial composite thread are combined into a composite thread and wound into a coil. In accordance with certain techniques, a melt spinning apparatus has a pre-swirling apparatus having a plurality of swirling nozzles, a post-swirling device having a plurality of post-swirling nozzles and a crimping device having a plurality of texturing nozzles, wherein the nozzles are designed such that an individual partial thread or a partial composite thread formed from a plurality of partial threads can optionally be processed.

14 Claims, 4 Drawing Sheets

Figure 1:
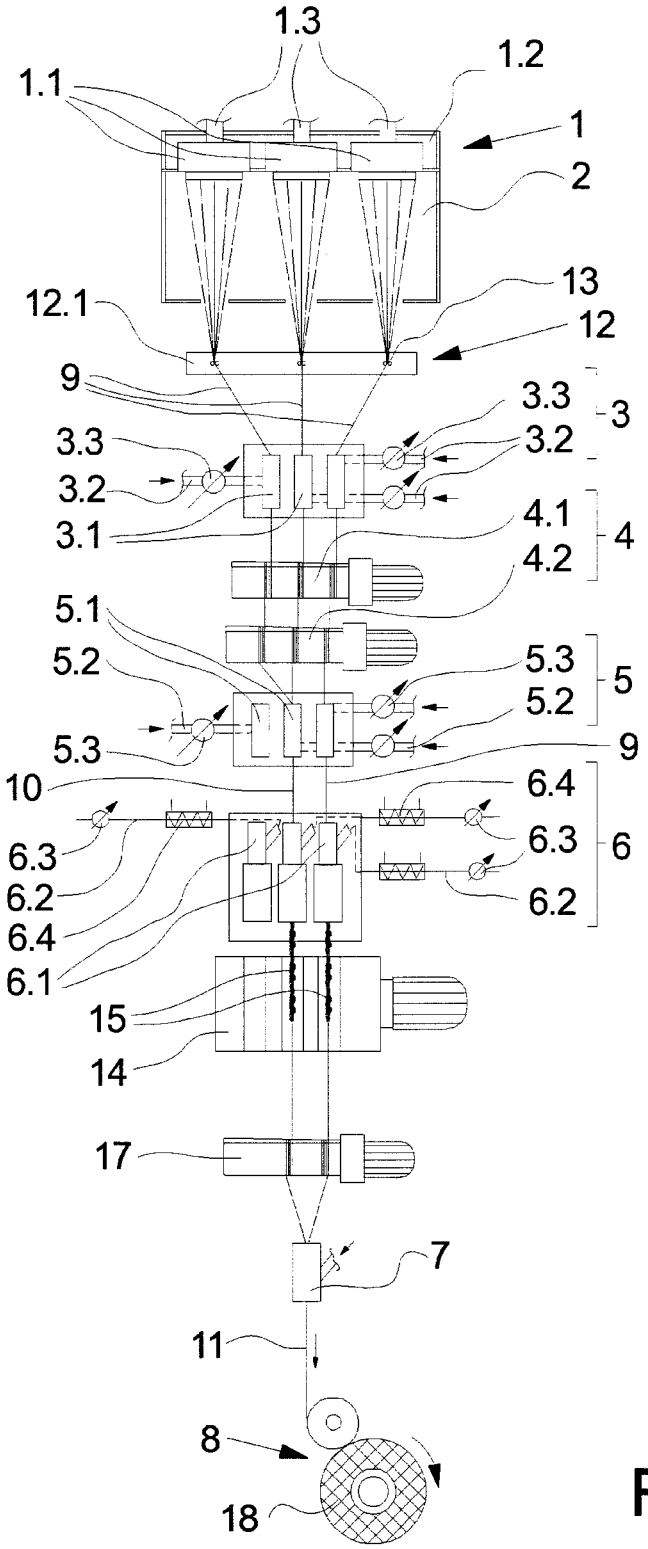

(51) Int. Cl.

| | |
|---|---|
| ***D01D 5/22*** | (2006.01) |
| ***D02G 1/12*** | (2006.01) |
| ***D02J 1/08*** | (2006.01) |
| *D01D 7/00* | (2006.01) |
| *D01D 13/02* | (2006.01) |

(52) U.S. Cl.
CPC ..... *D02J 1/08* (2013.01); *D01D 7/00* (2013.01); *D01D 13/02* (2013.01)

(58) Field of Classification Search
CPC ..... D01D 13/00; D01D 13/02; D02G 1/12; D02G 1/122; D02J 1/08
USPC ..... 264/103, 168, 210.2, 210.3, 210.8, 264/211.12, 211.14; 425/72.2, 102, 104, 425/135, 325, 378.2, 382.2, 463; 28/104, 28/263, 271
See application file for complete search history.

(56) References Cited

U.S. PATENT DOCUMENTS

| | | | | |
|---|---|---|---|---|
| 2005/0151295 | A1 | 7/2005 | Schemken et al. | |
| 2008/0041030 | A1* | 2/2008 | Stundl ..... | D02J 1/08 57/287 |
| 2018/0216259 | A1* | 8/2018 | Hubert ..... | D01D 5/22 |

FOREIGN PATENT DOCUMENTS

| | | | | |
|---|---|---|---|---|
| JP | 59116404 A * | 7/1984 | ..... | D01D 5/096 |
| WO | 2006081844 | 8/2006 | | |
| WO | 2012072297 | 6/2012 | | |
| WO | 2015039971 | 3/2015 | | |

* cited by examiner

METHOD AND MELT SPINNING APPARATUS FOR PRODUCING A CRIMPED, MULTICOLORED COMPOSITE THREAD

The invention relates to a method for producing in a melt spinning method a crimped multicolored composite thread from a plurality of extruded sub-threads, and to a melt spinning device for carrying out the method.

In the production of multicolored carpet yarns, a plurality of dissimilarly dyed sub-threads are usually produced in a melt spinning process and collected so as to form a composite thread. A generic method as well as a generic melt spinning device for producing multicolored carpet yarns of this type are known, for example, from WO 2006/081844.

In the known method and the known melt spinning device, the sub-threads are interlaced multiple times prior to the crimping. So-called pre-interlacing herein takes place prior to the drafting of the sub-threads. Post-interlacing takes place after the drafting and prior to the crimping, wherein the post-interlacing nozzles are controllable in a mutually separate manner in order for the sub-threads to be separately interlaced. In this way, different color effects which in the composite thread lead to a mixed color or to multicolor effects can be implemented in the composite thread.

In order to meet the rapidly changing fashion trends and thus the ever changing requirements set for carpet yarns, there is in practice the desire to be able to produce composite threads of this type with high flexibility in a melt spinning process. Moreover, ideally uniform physical properties are to be implemented herein on the sub-threads such that the composite thread is of high quality.

A method for generating a composite thread from a plurality of sub-threads in which the sub-threads are interlaced directly before and after texturizing is known from EP 0 861 931 A1. However, post-interlacing of the already textured sub-threads has the fundamental disadvantage that only limited mixing of filaments is possible by virtue of the texturized structure of the individual filaments. Moreover, the sub-threads after texturizing are usually cooled by way of a cooling medium such that the individual filaments of the sub-threads behave in a relatively rigid manner and in post-interlacing can thus be intermingled only by way of an increased input in terms of pressure.

It is therefore an object of the invention to refine a generic method for producing a crimped multicolored composite thread from extruded sub-threads and a generic melt spinning device for carrying out the method in such a manner that the composite thread is capable of being produced by way of a flexible and ideally large color spectrum from a plurality of colored sub-threads.

A further objective of the invention lies in refining the generic method and the generic melt spinning device in such a manner that a plurality of composite threads having dissimilar properties can be produced.

This object may be achieved by a method having features, as well as by a melt spinning device having features disclosed herein.

Advantageous refinements of the invention are defined by features and combinations of features disclosed herein.

The invention has the particular advantage that an individual treatment of the sub-threads is possible in each treatment stage, in particular in the pre-interlacing, the post-interlacing, and the crimping. The sub-threads herein can be treated separately or else conjointly as a composite sub-thread. The early collecting of a plurality of sub-threads so as to form a composite sub-thread achieves in particular novel color patterns not known to date, said color patterns ultimately being noticeable in the composite thread by way of a high level of color separation. In the method according to the invention, the colored filament bundles first are separately extruded and after cooling are collected so as to form in each case one sub-thread. Pre-interlacing of the individual sub-threads or of a composite sub-thread formed from a plurality of sub-threads takes place directly thereafter. The sub-threads and the composite sub-thread herein are pre-interlaced in a mutually independent manner. Drafting of the sub-threads and of the composite sub-thread takes place after the pre-interlacing. The filament composite generated by the pre-interlacing is to some extent undone herein. Subsequent separate post-interlacing of the individual sub-threads or the composite sub-thread formed from a plurality of sub-threads enables special color mixtures to be set which are then crimped in the separate texturizing of the individual threads and/or of the sub-thread and, when the latter are collected, result in the desired color effects of the composite thread.

For carrying out the method, the pre-interlacing nozzles and the post-interlacing nozzles and the texturizing nozzles in the case of the melt spinning device according to the invention are configured in such a manner that selectively an individual sub-thread or a composite sub-thread formed from a plurality of sub-threads is treatable. A multiplicity of yarn types can thus be produced by the melt-spinning device according to the invention without additional treatment apparatuses.

The flexibility for the production of the multicolored composite thread can even be increased in that at least one process parameter for the pre-interlacing of the individual sub-threads and/or of the composite sub-thread is freely selectable individually for each of the sub-threads and/or the composite sub-thread. There is thus the possibility for setting the treatment air pressure as the process parameter for each of the sub-threads or of the composite sub-thread. It is also possible herein to select a setting of the process parameter at which no interlacing takes place on the respective sub-thread.

To this end, the pre-interlacing nozzles of the pre-interlacing installation on the melt-spinning device are assigned a plurality of compressed-air infeed lines having separate compressed-air actuating means such that the pre-interlacing nozzles are controllable in a mutually independent manner. In this way it is possible for one sub-thread, one composite sub-thread, or no thread at all, to be treated in a corresponding manner in the pre-interlacing nozzles.

The post-interlacing nozzles of the post-interlacing installation are also assigned a plurality of compressed-air infeed lines having separate compressed-air actuating means in such a manner that the post-interlacing nozzles are controllable in a mutually independent manner. In this way, dissimilar compressed-air settings can also be implemented in the post-interlacing of the sub-threads or composite sub-threads.

Moreover, the method variant in which at least one process parameter for crimping the individual sub-threads and/or the composite sub-thread is freely selectable individually for each of the sub-threads and/or the composite sub-threads offers a further possibility for generating special color effects on the composite thread. The process parameter herein is formed substantially on account of the characteristic of the fluid which is used for conveying and for forming the plug when crimping. The temperature of the fluid as well as the pressure of the fluid that is supplied to the texturizing nozzles herein are preferably embodied so as to be controllable.

To this end, the texturizing nozzles of the crimping installation are assigned a plurality of supply lines having a plurality of setting means in such a manner that the texturizing nozzles are controllable in a mutually independent manner. The fluid in terms of temperature and pressure can thus be freely set at each of the texturizing nozzles.

In order for further color effects to be generated in the formation of the composite sub-thread from a plurality of sub-threads, the method variant in which the sub-threads of the composite sub-thread are mechanically mixed prior to the drafting is provided. In comparison to interlacing, elongate mixing zones of the filaments that in subsequent post-interlacing result in a particularly high color separation in a carpet generated from the composite thread thus result.

To this end, the melt spinning device has a mixing installation for mechanically mixing a plurality of sub-threads, said mixing installation being disposed upstream of the drafting installation.

The method according to the invention for producing a crimped multicolored composite thread as well as the melt spinning device according to the invention have the particular advantage that a plurality of dissimilar carpet yarns are advantageously producible in a single-stage process. In the prior art it is thus commonplace for generating yarn effects having a high color separation by way of a downstream secondary process. The latter can advantageously be dispensed on account of the method according to the invention and the device according to the invention. Yarn effects with an extremely high color separation in the case of the composite thread can advantageously be produced in one process step. Moreover, the relatively high production rates can be achieved herein.

Further effects can also be achieved in that the sub-threads and/or the composite sub-threads after the texturizing and prior to the collecting so as to form the composite thread are yet again imparted a final interlacing. To this end, a final interlacing installation is disposed so as to be downstream of the crimping installation in the thread run. To this end, the final interlacing installation could be disposed between godets and have a separate final interlacing nozzle for each sub-thread.

The method according to the invention for producing a crimped multicolored composite thread will be explained in more detail hereunder by means of a few exemplary embodiments of the melt spinning device according to the invention.

Figure 2:
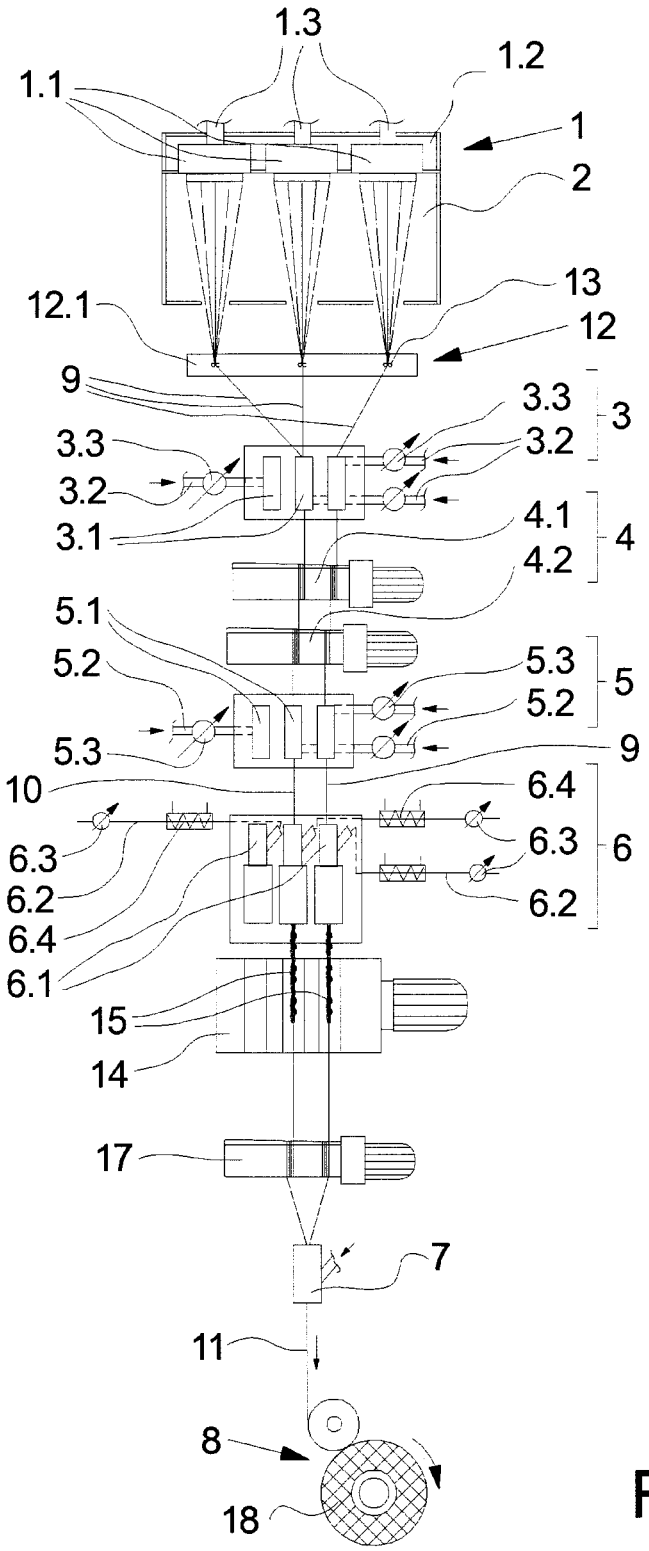
Figure 3:
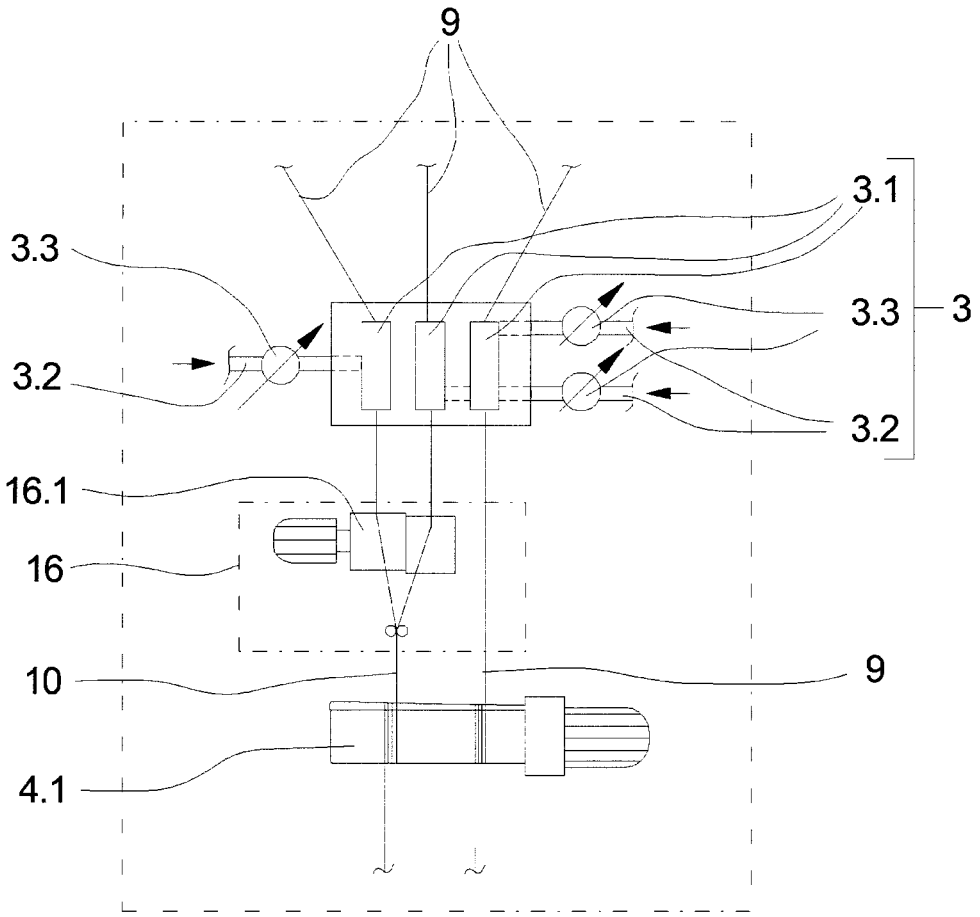
Figure 4:
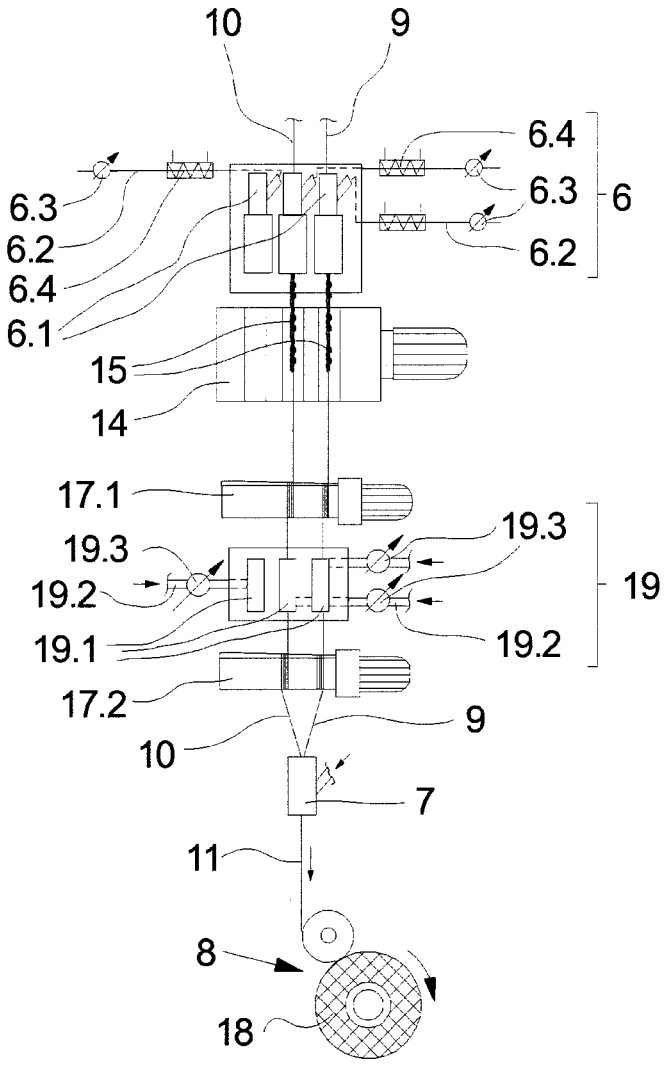

In the figures:

FIG. 1 schematically shows a first exemplary embodiment of the melt spinning device according to the invention for carrying out the method according to the invention;

FIG. 2 schematically shows the exemplary embodiment of the melt spinning device according to the invention as per FIG. 1, having a modified method management;

FIG. 3 schematically shows a variant of embodiment of the exemplary embodiment of the melt spinning device according to the invention from FIG. 1; and FIG. 4 schematically shows another variant of embodiment of the exemplary embodiment of the melt spinning device according to the invention from FIG. 1.

A first exemplary embodiment of the melt spinning device according to the invention for carrying out the method according to the invention for producing a crimped multicolored composite thread is schematically illustrated in FIG. 1.

The melt spinning device has a spinning installation 1, a cooling installation 2, a preparation installation 12, a pre-interlacing installation 3, a drafting installation 4, a post-interlacing installation 5, a crimping installation 6, a interconnecting installation 7, and a winding installation 8. The installations of the melt spinning device are disposed so as to form a thread run in the machine frame (not illustrated here).

The vertical thread run illustrated in FIG. 1 is exemplary. In principle, the installations can be disposed below one another or else beside one another.

The installations used for the production of a plurality of colored polymers are not illustrated here. The spinning installation 1 is thus usually coupled to 3 extruding installations so as to obtain three polymer melts in dissimilar colorations.

The spinning installation 1 in this exemplary embodiment has a spinning beam 1.2 which on the lower side thereof supports a plurality of spinning nozzles 1.1. The spinning beam 1.2 is embodied so as to be heated. Each of the spinning nozzles 1.1 by way of a separate melt infeed 1.3 is coupled to a plurality of spinning pumps (not illustrated here). A polymer melt can thus be extruded so as to form a multiplicity of filaments at each of the spinning nozzles 1.1. To this end, the spinning nozzles 1 on the lower sides thereof have a plurality of nozzle bores.

A total of three spinning nozzles 1.1 so as to extrude three filament bundles of dissimilar colors are provided in the exemplary embodiment according to FIG. 1. To this end, the melt spinning device illustrated is particularly suitable for producing a so-called tricolor composite thread.

The cooling installation 2 by way of which the freshly extruded filaments are cooled is disposed directly downstream of the spinning installation 1. The filaments for cooling in the cooling installation 2 are preferably impinged with cooling air. The cooling air herein can be fed radially from the inside to the outside, transversely, or radially from the outside to the inside.

The cooling installation 2 is assigned a preparation installation 12 and a plurality of collective thread guides 13 in order for the filaments after the cooling to in each case be collected so as to form bundles and to form a sub-thread 9. The preparation installation 12 has at least one wetting means 12.1 in order for the sub-threads 9 to be conjointly prepared. However, there is also the possibility that the preparation installation 12 contains a plurality of wetting agents 12.1 so that each of the sub-threads 9 is capable of being separately wetted.

The treatment of the sub-threads 9 first takes place by the pre-interlacing installation 3. The pre-interlacing installation 3 has a plurality of pre-interlacing nozzles 3.1 which by separate compressed-air lines 3.2 and separate compressed-air actuating means 3.3 are coupled to a compressed-air source (not illustrated here). The pre-interlacing installation 3 in this exemplary embodiment possesses a total of three separate pre-interlacing nozzles 3.1 so that each of the sub-threads 9 could be imparted separate pre-interlacing in the pre-interlacing nozzles 3.1.

The pre-interlacing installation 3 is followed by the drafting installation 4 which has a plurality of godets 4.1 and 4.2 for drafting the sub-threads 9. The godets 4.1 and 4.2 are preferably configured as godets which are wrapped multiple times, the godet jacket of said godets preferably being embodied so as to be heatable. The sub-threads 9 thus can first be thermally treated and drafted.

It is to be expressly mentioned at this point that the configuration of the drafting installation 4 is exemplary. In principle, the drafting installation 4 can also have a plurality of godets in order for the sub-threads 9 to be drafted in a plurality of stages.

The drafting installation 4 in the thread run is followed by the post-interlacing installation 5. The post-interlacing installation 5 has a plurality of post-interlacing nozzles 5.1 which by a plurality of compressed-air infeed lines 5.2 and a plurality of compressed-air actuating means 5.3 are connected to a compressed-air source (not illustrated here). To this extent, the post-interlacing nozzles 5.1 can be separately controlled, wherein the respective setting of the compressed air is freely selectable. In this exemplary embodiment, each sub-thread is likewise assigned a separate post-interlacing nozzle 5.1.

The post-interlacing installation 5 is followed by the crimping installation 6. The crimping installation 6 is embodied as a so-called stuffer box crimping unit and to this end has a plurality of texturizing nozzles 6.1. Each of the texturizing nozzles 6.1 is configured in two parts and has a conveying part and a stafling part so as to compress an infed thread to form a thread plug. The filaments herein are deposited in arcs and loops so that a crimp is created. To this end, the texturizing nozzles 6.1 by way of a plurality of supply lines 6.2 and a plurality of setting means 6.3 are connected to a fluid source (not illustrated here). The fluid herein by a plurality of heating means 6.4 can in each case be heated to a predetermined temperature in a manner separate for each texturizing nozzle 6.1. The respective setting means 6.3 herein are suitable for controlling the heating temperature of the fluid as well as the pressure of the fluid. To this extent, each of the texturizing nozzles 6.1 of the crimping installation 6 is separately controllable. The crimping installation 6 in this exemplary embodiment has three texturizing nozzles 6.1 so that each of the sub-threads 9 generated in the spinning installation 1 could be separately texturized.

The pre-interlacing nozzles 3.1 of the interlacing installation 3, the post-interlacing nozzles 5.1 of the post-interlacing installation 5, and the texturizing nozzles 6.1 of the crimping installation 6 in terms of the guiding cross section thereof are configured in such a manner that, alternatively to the sub-threads 9, a composite sub-thread 10 formed from a plurality of sub-threads 9 could also be treated. The production of a composite thread 11 in which all sub-threads 9 first are separately pre-interlaced by the pre-interlacing nozzles 3.1 in the pre-interlacing installation 3 is thus illustrated in the exemplary embodiment according to FIG. 1. After the drafting of the sub-threads 9, two of the sub-threads 9 are collected so as to form a composite sub-thread 10 and are post-interlaced in parallel with the third sub-thread 9 by two post-interlacing nozzles 5.1 in the post-interlacing installation 5. One of the post-interlacing nozzles 5.1 herein remains devoid of a function.

In the following crimping installation 6, likewise only two texturing nozzles 6.1 are used herein in order for the composite sub-thread 10 and the third sub-thread 9 to be separately crimped. To this extent, dissimilar mixed colors can be generated in the later composite thread 11.

The thread plugs 15 generated by the crimping installation 6 are cooled on the circumference of a cooling drum 14 and by a downstream take-off installation 17 are dissolved so as to in each case form a crimped composite sub-thread 10 and a crimped sub-thread 9. The crimped threads are subsequently collected in the interconnecting installation 7 so as to form the composite thread 11. The interconnecting installation 7 herein is preferably formed by an entanglement nozzle in which the sub-thread 9 and the composite sub-thread 10 are connected to one another by a plurality of entanglement knots.

In order for a thread tension for setting when entangling in the interconnecting installation 7 to be obtained independently from winding, a further godet unit is preferably disposed downstream of the interconnecting installation 7.

At the end of the process, the composite thread 11 is wound in the winding installation 8 so as to form a wound package 18.

In the method according to the invention which is capable of being carried out by the melt spinning device illustrated in FIG. 1, a plurality of sub-threads 9 are first separately generated in the spinning installation 1. In order for a yarn having dissimilar properties such as, for example, color, luster, linear mass density, filament count, cross section, or polymer, to now be obtained, the treatment stages of pre-interlacing, post-interlacing, and crimping can be individually utilized. The sub-threads 9 can first be pre-interlaced, post-interlaced, and crimped separately, or partially in a conjoint manner. A high flexibility for generating the thread type of the composite thread desired in each case is guaranteed by virtue of the setting capability of the individual nozzles in the pre-interlacing installation 3, the post-interlacing installation 5, and the crimping installation 6. Properties which otherwise are implementable only in a multi-staged process can be generated on the composite thread herein.

The exemplary embodiment of the melt spinning device from FIG. 1 is illustrated in FIG. 2, wherein a modified thread type of the composite thread 11 is generated. In the exemplary embodiment illustrated in FIG. 2, two of the sub-threads 9 immediately after the cooling are collected so as to form a composite sub-thread 10 and are pre-interlaced separately in parallel beside the third sub-thread 9 by the pre-interlacing nozzles 3.1. The composite sub-thread 10 thus formed and the sub-thread 9 are subsequently drafted and separately post-interlaced and crimped. To this extent, a dissimilarly crimped multicolored composite thread 11 is generated.

In the case of the exemplary embodiment of the method according to the invention illustrated in FIGS. 1 and 2, the multicolored filaments in the composite sub-thread 10 are intermingled by compressed-air treatments and by crimping. However, in principle there is also the possibility for the intermingling of the multicolored filaments of two sub-threads be generated by mechanical means. To this end, an exemplary embodiment in which a mixing installation 16 is utilized for connecting two sub-threads 9 so as to form a composite sub-thread 10 is illustrated in FIG. 3. The mixing installation 16 herein could be disposed upstream of the drafting installation 4 so that the sub-threads after a pre-interlacing are collected by the mixing installation 16 so as to form the composite sub-thread 10. The mixing installation 16 in FIG. 3 is formed by a rotating cam roller 16.1 in which the filaments of the sub-threads 9 are intermingled on account of a movement transverse to the thread-running direction. In this way, other distributions of the filaments within the composite sub-thread 10 can be implemented, this subsequently leading to specific color effects on account of the post-interlacing and crimping.

In order for further color and yarn effects to be achieved, a further exemplary embodiment of the device according to the invention is illustrated in a partial view in FIG. 4. The thread run from the crimping installation 6 up to a winding installation 8 is shown herein. The installations which are disposed upstream of the crimping installation 6 are identical to those of the exemplary embodiment according to FIGS. 1 and 2 so that no further explanation thereto is offered and reference is made to the afore-mentioned description.

In the exemplary embodiment illustrated in FIG. 4, a final interlacing installation 19 is disposed downstream of the crimping installation 6. The final interlacing installation 19 is integrated in the take-off installation 17 which is formed by two take-off godets 17.1 and 17.2. The final interlacing installation 19 is disposed between the take-off godets 17.1 and 17.2. The final interlacing installation 19 has a plurality of final interlacing nozzles 19.1 which by separate compressed-air infeed lines 19.2 and separate compressed-air actuating means 19.3 are coupled to a compressed-air source (not illustrated here). The final interlacing installation 19 in this exemplary embodiment possesses a total of three separate final interlacing nozzles 19.1 so that each of the sub-threads 9 could be imparted separate final interlacing in the final interlacing nozzles 19.1.

Only two final interlacing nozzles 19.1 are activated in the exemplary embodiment illustrated in FIG. 4, so that a sub-thread 9 and the composite sub-thread 10 are imparted final interlacing after the crimping. The final interlacing of the crimped threads 9 and 10 thus leads to further special effects when brought together so as to form a composite thread 11.

In the method according to the invention as well as in the melt spinning device the pre-interlacing actions and the post-interlacing actions can be generated by rotating interlacing nozzles or by static interlacing nozzles. Further effects can be implemented therewith. Very intensive interlacing actions of the filaments can be generated in particular by way of a rotating interlacing nozzle such as is known, for example, from EP 2 646 608 B1. To this extent, the known rotating interlacing nozzle is particularly suitable for carrying out pre-interlacing and/or post-interlacing.

The invention claimed is:

1. A method for producing in a melt spinning method a crimped multicolored composite from a plurality of extruded sub-threads in the following steps:

1.1 separately extruding a plurality of colored filament bundles, and cooling the filament bundles;

1.2 separately gathering the filament bundles so as to form the separate sub-threads;

1.3 pre-interlacing;

1.4 drafting;

1.5 post-interlacing;

1.6 texturizing;

wherein a composite sub-thread is formed from some of the individual subthreads a) between steps 1.2 and 1.3, or b) between steps 1.3 and 1.4, or c) between steps 1.4 and 1.5, or d) between steps 1.5 and 1.6, wherein selectively one or more individual sub threads and/or the composite sub thread is individually treatable, and wherein the method further comprises the following steps:

1.7 collecting the individual sub-threads and/or the composite sub-thread so as to form the composite thread; and 1.8 winding the composite thread so as to form a wound package.

2. The method as claimed in claim 1, wherein at least one process parameter for the pre-interlacing of the individual sub-threads and/or the composite sub-thread is freely selectable individually for each of the sub-threads and/or the composite sub-thread.

3. The method as claimed in claim 1 wherein at least one process parameter for the post-interlacing of the individual sub-threads and/or the composite sub-thread is freely selectable individually for each of the sub-threads and/or the composite sub-thread.

4. The method as claimed in claim 1 wherein at least one process parameter for the crimping of the individual sub-threads and/or the composite sub-thread is freely selectable individually for each of the sub-threads and/or the composite sub-thread.

5. The method as claimed in claim 1 wherein the sub-threads are wetted with a spin-finish agent when separately gathering the filament bundles.

6. The method as claimed in claim 1 wherein the sub-threads are mechanically mixed prior to the drafting of the composite sub-thread.

7. The method as claimed in claim 1, wherein thread plugs, which are generated when crimping the sub-threads and/or the composite sub-threads, are separately cooled.

8. A melt spinning device configured for producing a crimped multicolored composite thread, the melt spinning device comprising:

a spinning installation having a plurality of spinning nozzles configured for separately extruding a plurality of colored filament bundles, a cooling installation configured for cooling the filament bundles, a plurality of collective thread guides configured for separately gathering the filament bundles so as to form separate sub-threads, a pre-interlacing installation having a plurality of pre-interlacing nozzles, a drafting installation having a plurality of godets, a post-interlacing installation having a plurality of post-interlacing nozzles, a crimping installation having a plurality of texturizing nozzles, wherein the melt spinning device is configured such that one or more composite sub-threads are formed from some of the sub-threads a) between the collective thread guides and the pre-interlacing installation, or b) between the pre-interlacing installation and the drafting installation, or c) between the drafting installation and post-interlacing installation, or d) between the post-interlacing installation and the crimping installation, and wherein the pre-interlacing nozzles of the pre-interlacing installation, the post-interlacing nozzles of the post-interlacing installation, and the texturizing nozzles of the crimping installation are configured in such a manner that selectively one or more individual sub-threads or a and/or said one or more composite sub-threads is individually treatable, an interconnecting installation configured for forming the composite thread from said one or more individual sub-threads and said one or more composite sub-threads, and a winding installation configured for winding the composite thread so as to form a wound package.

9. The melt spinning device as claimed in claim 8, wherein the pre-interlacing nozzles of the pre-interlacing installation are assigned a plurality of compressed-air infeed lines having separate compressed-air actuating means in such a manner that the pre-interlacing nozzles are controllable in a mutually independent manner.

10. The melt spinning device as claimed in claim 8 wherein the post-interlacing nozzles of the post-interlacing installation are assigned a plurality of compressed-air infeed lines having separate compressed-air actuating means in such a manner that the post-interlacing nozzles are controllable in a mutually independent manner.

11. The melt spinning device as claimed in claim 8, wherein the texturizing nozzles of the crimping installation are assigned a plurality of supply lines having a plurality of setting means in such a manner that the texturizing nozzles are controllable in a mutually independent manner.

12. The melt spinning device as claimed in claim 8, wherein a preparation installation which has one or a plurality of wetting agents for wetting the sub-threads is assigned to the collective thread guides.

13. The melt spinning device as claimed in claim 8, wherein the drafting installation is assigned a mixing installation for mechanically mixing a plurality of sub-threads of a composite sub-thread.

14. The melt spinning device as claimed in claim 8, wherein the crimping installation is assigned a rotatable cooling drum for receiving and cooling a plurality of thread plugs.

* * * * *